US005392152A

United States Patent [19]

Higgins et al.

[11] Patent Number: 5,392,152

[45] Date of Patent: Feb. 21, 1995

[54] QUASI-OPTIC AMPLIFIER WITH SLOT AND PATCH ANTENNAS

[75] Inventors: J. Aiden Higgins, Westlake Village; Emilio A. Sovero, Thousand Oaks, both of Calif.

[73] Assignee: Rockwell International Corporation, Seal Beach, Calif.

[21] Appl. No.: 137,235

[22] Filed: Oct. 13, 1993

[51] Int. Cl.[6] ..... H01Q 13/26

[52] U.S. Cl. ..... 359/333; 330/286; 342/175

[58] Field of Search ..... 359/333, 344; 330/286, 330/295; 342/175

[56] References Cited

U.S. PATENT DOCUMENTS

| | | | |
|---|---|---|---|
| 4,588,962 | 5/1986 | Saito et al. | 330/286 |
| 5,115,245 | 5/1992 | Wen et al. | 342/175 |
| 5,214,394 | 5/1993 | Wong | 330/286 |
| 5,266,963 | 11/1993 | Carter | 343/850 |

*Primary Examiner*—Mark Hellner
*Attorney, Agent, or Firm*—John C. McFarren

[57] ABSTRACT

A monolithic quasi-optic amplifier is provided for co-linear beam propagation in the millimeter wave frequency range (30–300 GHz). The amplifier comprises a multiplicity of unit cells that act as nearly independent amplifiers. Each unit cell includes a GaAs transistor, a slot antenna, a patch antenna, a microstrip line, and a DC bias provided by a ground plane that routes non-radiating transmission lines without interference. The slot antennas on GaAs provide preferential directionality in receiving the input waves. A vertically polarized input wave couples energy into each unit cell through the slots in the ground plane, through the microstrip lines, and to the base of each transistor. After amplification by the transistors, the signal is fed to the patch antennas, which generate a horizontally polarized output wave. The size of each patch antenna, which is determined by the operating frequency, is approximately 1 mm by 1 mm in GaAs at 44 GHz.

19 Claims, 2 Drawing Sheets

QUASI-OPTIC AMPLIFIER WITH SLOT AND PATCH ANTENNAS

TECHNICAL FIELD

The present invention relates to power amplification in the millimeter wave frequency range and, in particular, to a monolithic quasi-optic amplifier having slot and patch antennas.

BACKGROUND OF THE INVENTION

The millimeter wave frequency range (30–300 GHz) has advantages for many communication and radar applications because of the wide bandwidth and high angular resolution for a given antenna size. The development of millimeter wave (mm wave) systems has been hindered, however, by the immature technology of components such as power amplifiers. Currently available systems use traveling wave tubes (TWTs), which are expensive, require high voltage power supplies, and are vulnerable to single point failure. An alternative is the use of solid state Impact devices, which are expensive and difficult to tune. Because the technologies related to both TWTs and Impact devices are relatively mature, order of magnitude improvements in performance and cost seem unlikely.

Gallium arsenide (GaAs) transistors, either heterojunction bipolar transistors (HBTs) or high electron mobility transistors (HEMTs), offer promise for mm wave power amplification. Unlike Impact diodes, these are three-terminal devices that are much easier to control. However, HBTs and HEMTs suffer from fundamental limitations in terms of the amount of power that can be generated from each discrete device. Typically, the amount of power generated by a device is inversely proportional to the square of the frequency (i.e., $p \sim 1/f^2$) For devices operating at the extremely high frequencies in the mm wave range, the maximum power for a single transistor is low (on the order of 200–250 mW at 44 GHz, for example). Therefore, the combined output of many transistors is needed to provide power for practical systems, which can require from several to hundreds of watts.

Conventional approaches to power combining at mm wave frequencies use bulky waveguides and/or precision transmission lines. The lossiness of passive networks using these components imposes an upper limit on the maximum power attainable, which falls significantly short of the requirements for many systems. What is needed is mm wave power amplifier that can achieve an order of magnitude (or greater) improvement in performance and cost compared with conventional technologies.

SUMMARY OF THE INVENTION

The present invention comprises a monolithic quasi-optic amplifier for the millimeter wave frequency range (30–300 GHz). The structure of the amplifier may include a ground plane having slots, a GaAs substrate, patch antennas on the circuit side of the GaAs, an aluminum nitride substrate that provides heat dissipation, and parasitic patches atop the nitride layer. The amplifier comprises a multiplicity of unit cells, each cell including a GaAs transistor, a slot antenna, a patch antenna, a microstrip line, and a DC bias. Each unit cell (or pair of unit cells) acts as a nearly independent amplifier. Input and output beam propagation is co-linear: the input beam is amplified as it traverses the plane of the amplifier. The well-defined ground plane allows the use of non-radiating transmission lines to supply DC bias without interfering with the electromagnetic fields.

The slot antennas on GaAs provide preferential directionality in receiving the input waves. A vertically polarized input wave (for example) couples energy into each unit cell through the slots in the ground plane, through vias to the microstrip lines, and then to the base of each transistor. After amplification by the transistors, the signal is fed to the patch antennas, which generate a horizontally polarized output wave (for example). The dimensions of the patch antennas are determined by the operating frequency. In GaAs at 44 GHz, for example, each patch antenna is approximately 1 mm by 1 mm.

A principal object of the invention is amplification of electromagnetic signals in the millimeter wave frequency range (30–300 GHz). A feature of the invention is a grid of slot input antennas, GaAs transistors, and patch output antennas. An advantage of the invention is a monolithic device that amplifies a quasi-optic beam as it traverses the plane of the amplifier.

BRIEF DESCRIPTION OF THE DRAWINGS

For a more complete understanding of the present invention and for further advantages thereof, the following Detailed Description of the Preferred Embodiment makes reference to the accompanying Drawings, in which.

DETAILED DESCRIPTION OF THE PREFERRED EMBODIMENT

Figure 1:
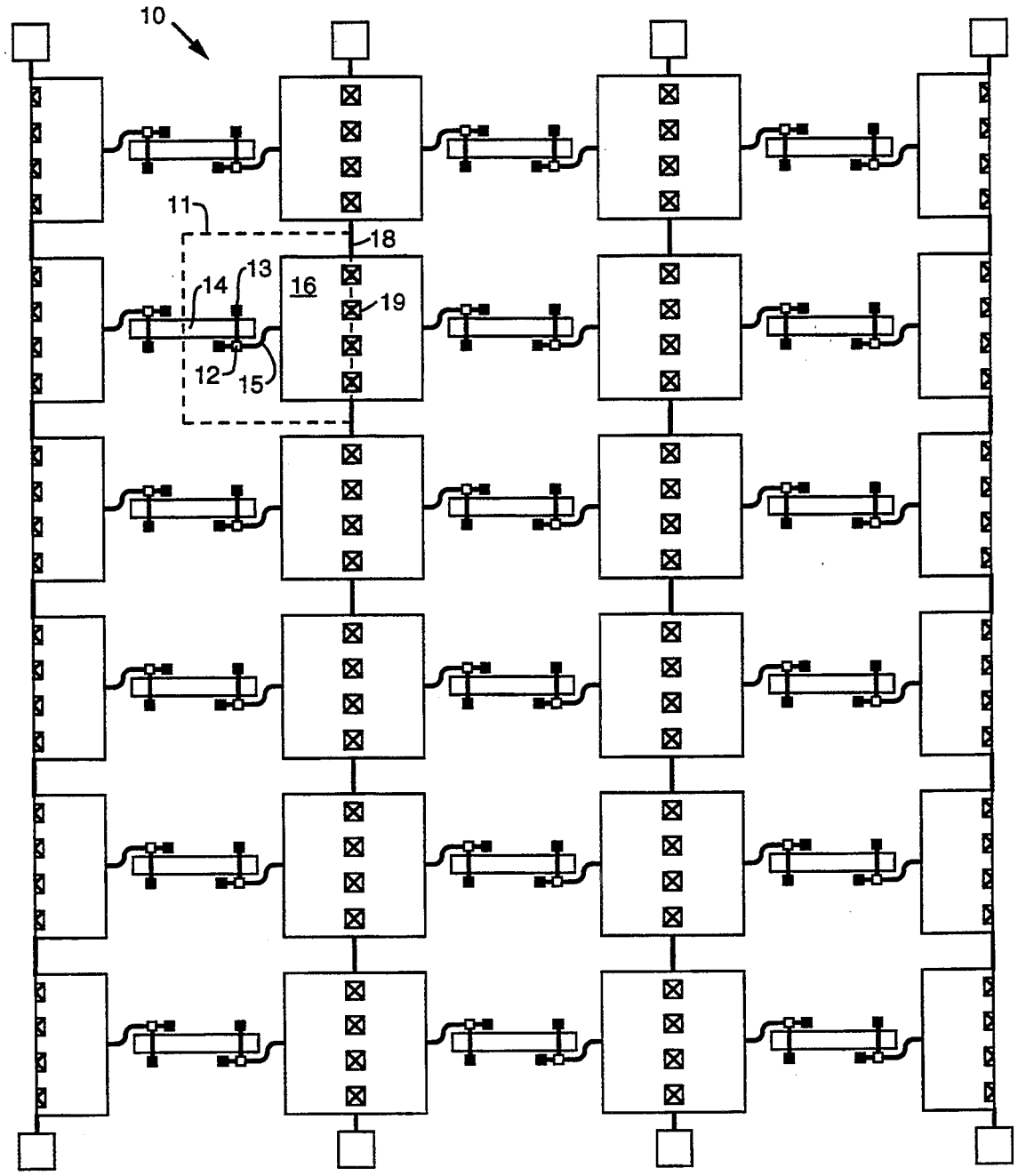
FIG. 1 is a plan view of a monolithic quasi-optic amplifier of the present invention having an array of slot antennas, patch antennas, and 36 transistors.

The present invention comprises a monolithic quasi-optic amplifier for transmitting signals in the millimeter wave frequency range (30–300 GHz). As illustrated in FIG. 1, amplifier 10 comprises a weakly coupled array of amplifier cells formed monolithically on a GaAs substrate. Input beams are amplified as they traverse the plane of amplifier 10 such that input and output beam propagation is co-linear through amplifier 10. Each unit cell of amplifier 10, such as unit cell 11 surrounded by a dotted line in FIG. 1 and expanded in the schematic diagram of FIG. 2, includes a GaAs transistor 12 (such as a heterojunction bipolar transistor (HBT), for example) with base connected to a via 13, a slot antenna 14, a patch antenna 16, a microstrip line 15, a DC bias line 18, and vias 19. In the configuration of FIG. 1, each unit cell (or pair of unit cells) functions as a nearly independent amplifier.

Figure 3:
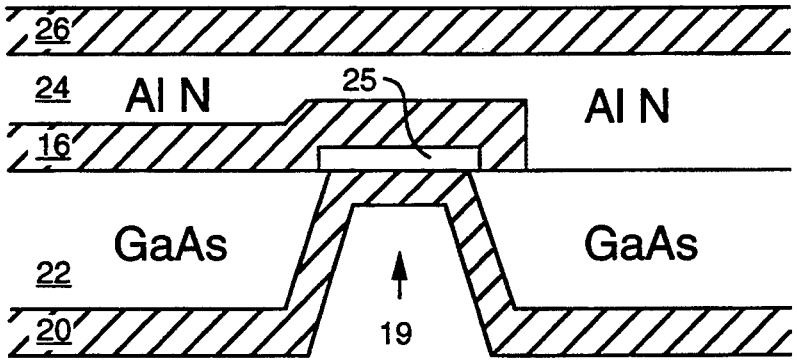
FIG. 3 is a schematic cross-section taken along the section line 3—3 of the unit cell of FIG. 2 illustrating a bypass via (capacitor to ground) used to decouple the DC bias lines of the quasi-optic amplifier.

As shown more clearly in the cross-section of FIG. 3, the structure of monolithic amplifier 10 generally includes a ground plane comprising a metal layer 20 (such as gold, for example, which includes windows or gaps forming the slot antennas), a GaAs substrate 22, metal patch antennas 16 on the transistor circuit side of GaAs layer 22, an aluminum nitride layer 24, and non-biased metal parasitic patches 26 atop nitride layer 24. Aluminum nitride layer 24 provides heat dissipation and proper spacing between patch antennas 16 and parasitic patches 26. The well-defined ground plane 20 allows the routing of non-radiating transmission lines, such as DC bias line 18, without interfering with the propagating electromagnetic fields.

Figure 2:
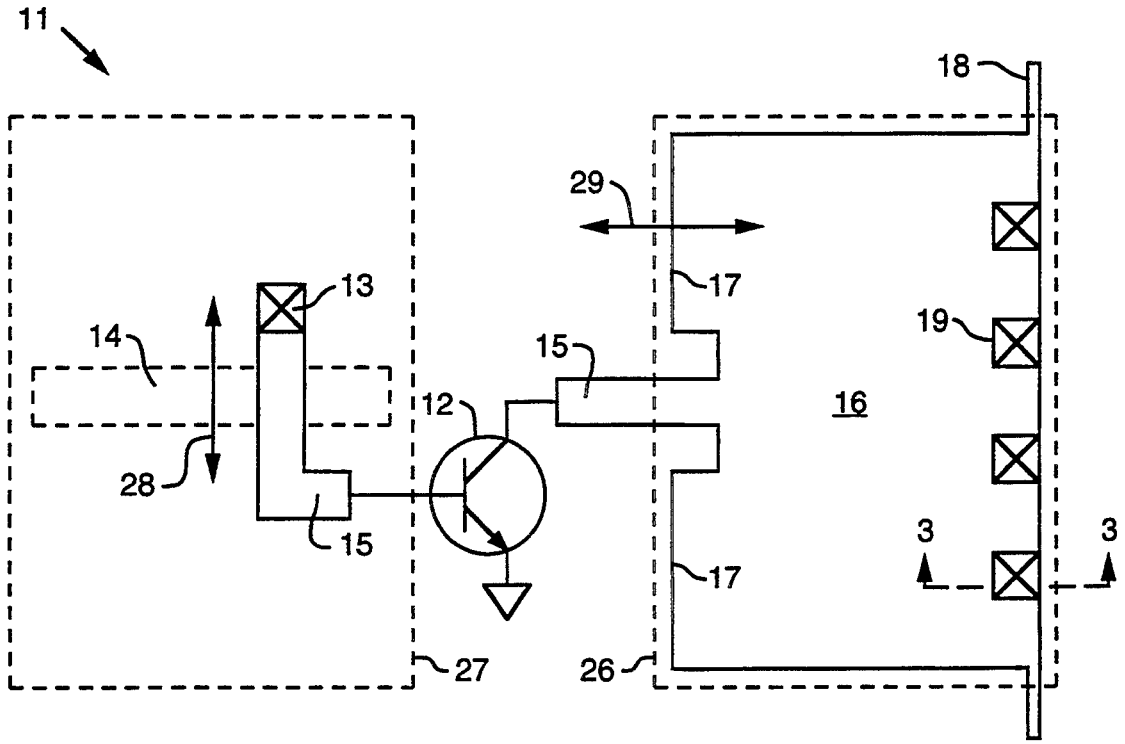
FIG. 2 is a schematic plan view of a unit cell of the quasi-optic amplifier of FIG. 1.

Slot antennas 14, formed as windows or gaps in ground plane 20, provide preferential directionality in receiving the input waves, such as vertically polarized input wave 28 shown in FIG. 2, for example. In the preferred embodiment, vertically polarized input wave 28 couples energy into each unit cell through the slot 14 in ground plane 20, through via 13 to microstrip line 15, and then to the base of each transistor 12. After amplification by transistor 12, the signal is fed to patch antenna 16, which generates a horizontally polarized output wave 29. Patch antennas 16 can be very efficient and can have bandwidths on the order of 15% when used with parasitic patches 26. Parasitic patches comprise conductor rectangles approximately 10% larger in area than patch antennas 16. Parasitic patches 26 are placed above patch antennas 16 and are electrically isolated without electrical bias. Parasitic patches 27 may also be spaced apart from ground plane 20 and placed below slot antennas 14. An additional benefit of parasitic patches 26 and 27 is their function as matching elements allowing more flexibility to accommodate variations in active device performance.

The operating frequency of amplifier 10 determines the dimensions of patch antennas 16. In GaAs at 44 GHz, for example, each patch antenna is approximately 1 mm by 1 mm. The radiating edges of patch antenna 16 are the edges 17 perpendicular to microstrip line 15. The radiation field polarization (i.e., output wave 29) is perpendicular to edges 17. Patch antenna 16 is a resonant structure with its fundamental mode having a node along a center line of the patch (i.e., a virtual ground). The virtual ground provides a convenient biasing point to bring DC bias lines 18 to the active devices of amplifier 10, as shown in FIGS. 1 and 2. As shown in the cross-section of FIG. 3, a thin nitride layer 25 can be used with bypass vias 19 (i.e., capacitor to ground) to decouple the DC bias lines. In addition, the area in GaAs required by patch antenna 16 can be reduced in half by sharing a full patch with a pair of transistors, as shown in the central area of FIG. 1, or by using half patches, as shown along the left and right sides of FIG. 1.

Initial design studies have calculated a structure of amplifier 10 comprising a ground plane 20, a 75 micron GaAs substrate 22, a 1 mm by 1 mm driven patch antenna 16 on the circuit side of GaAs layer 22, an aluminum nitride substrate 1.7 mm thick, and a 1.25 mm by 1.25 mm parasitic patch 26. The predicted return loss for this design is better than 10 dB from about 43 to 45 GHz.

Although the present invention has been described with respect to specific embodiments thereof, various changes and modifications can be carried out by those skilled in the art without departing from the scope of the invention. Therefore, it is intended that the present invention encompass such changes and modifications as fall within the scope of the appended claims.

We claim:

1. A monolithic quasi-optic transmission amplifier, comprising:

a ground plane;

a semiconductor substrate atop said ground plane;

a slot antenna formed in said ground plane for receiving radiation in the millimeter wave frequency range as an input to the amplifier;

a transistor formed on said semiconductor substrate and connected to said slot antenna for amplifying said input;

a patch antenna formed atop said substrate and connected to said transistor for transmitting said amplified input as output radiation in the millimeter wave frequency range co-linear with said received radiation.

2. The monolithic quasi-optic transmission amplifier of claim 1, wherein said semiconductor substrate comprises GaAs and said transistor comprises a heterojunction bipolar transistor (HBT) having a base, a collector, and an emitter.

3. The monolithic quasi-optic transmission amplifier of claim 2, further comprising a microstrip line coupling said slot antenna to said base of said transistor and said patch antenna to said collector.

4. The monolithic quasi-optic transmission amplifier of claim 1, further comprising a nitride layer atop said patch antenna.

5. The monolithic quasi-optic transmission amplifier of claim 4, further comprising an electrically isolated first parasitic patch atop said nitride layer over said patch antenna and a second parasitic patch spaced apart from said ground plane below said slot antenna.

6. The monolithic quasi-optic transmission amplifier of claim 1, further comprising a plurality of said slot antennas, transistors, and patch antennas connected to form a plurality of amplifier unit cells.

7. A monolithic quasi-optic transmission amplifier, comprising:

a ground plane;

a semiconductor substrate atop said ground plane;

a plurality of amplifier unit cells forming an array on said ground plane and substrate, each of said unit cells comprising a slot antenna formed in said ground plane for receiving radiation in the millimeter wave frequency range as an input to the amplifier, a transistor formed on said semiconductor substrate and connected to said slot antenna for amplifying said input, and a patch antenna formed atop said substrate and connected to said transistor for radiating an amplified millimeter wave output co-linear with said received radiation.

8. The monolithic quasi-optic transmission amplifier of claim 7, wherein said slot antennas comprise windows in said ground plane.

9. The monolithic quasi-optic transmission amplifier of claim 8, wherein said semiconductor substrate comprises GaAs.

10. The monolithic quasi-optic transmission amplifier of claim 9, further comprising a nitride layer over each of said patch antennas on said GaAs substrate.

11. The monolithic quasi-optic transmission amplifier of claim 10, wherein each of said unit cells further comprises an electrically isolated first parasitic patch atop said nitride layer over said patch antenna and a second parasitic patch spaced apart from said ground plane below said slot antenna.

12. The monolithic quasi-optic transmission amplifier of claim 11, wherein said transistor of each of said unit cells comprises a heterojunction bipolar transistor (HBT) having a base, a collector, and an emitter, and each of said unit cells further comprises a microstrip line connecting said collector to said patch antenna and said base to a via coupled to said slot antenna.

13. The monolithic quasi-optic transmission amplifier of claim 12, wherein said patch antennas include ground plane vias for decoupling DC bias lines connected to said patch antennas.

14. A monolithic quasi-optic transmission amplifier, comprising:

a ground plane;

a GaAs substrate atop said ground plane;

a plurality of slot antennas formed in said ground plane and said GaAs substrate, said slot antennas for receiving input radiation in the millimeter wave frequency range;

a corresponding plurality of patch antennas formed atop said GaAs substrate for radiating an output in the millimeter wave frequency range co-linear with said input radiation; and a corresponding plurality of transistors formed in said GaAs substrate, each of said transistors coupled between one of said slot antennas and one of said patch antennas for amplifying said input radiation and generating said output.

15. The monolithic quasi-optic transmission amplifier of claim 14, wherein each of said transistors comprises a heterojunction bipolar transistor (HBT) having a base, a collector, and an emitter.

16. The monolithic quasi-optic transmission amplifier of claim 15, further comprising a microstrip line connecting said collector to said patch antenna and said base to a via coupled to said slot antenna.

17. The monolithic quasi-optic transmission amplifier of claim 16, further comprising a nitride layer atop said patch antennas.

18. The monolithic quasi-optic transmission amplifier of claim 17, further comprising a plurality of electrically isolated parasitic patches, said parasitic patches formed atop said nitride layer over a corresponding one of said patch antennas and spaced apart from said ground plane below said slot antennas.

19. The monolithic quasi-optic transmission amplifier of claim 18, wherein said patch antennas include ground plane vias for decoupling DC bias lines connected to said patch antennas.

* * * * *